US008963432B2

(12) United States Patent
Ishikita

(10) Patent No.: US 8,963,432 B2
(45) Date of Patent: Feb. 24, 2015

(54) LIGHTING SYSTEM, CONTROL METHOD THEREFOR AND LIGHTING CONTROL DEVICE

(75) Inventor: Toru Ishikita, Kanagawa-ken (JP)

(73) Assignee: Toshiba Lighting & Technology Corporation, Kanagawa (JP)

( * ) Notice: Subject to any disclaimer, the term of this patent is extended or adjusted under 35 U.S.C. 154(b) by 38 days.

(21) Appl. No.: 13/612,721

(22) Filed: Sep. 12, 2012

(65) Prior Publication Data

US 2013/0334969 A1 Dec. 19, 2013

(30) Foreign Application Priority Data

Jun. 14, 2012 (JP) ..... 2012-134754

(51) Int. Cl.
*H05B 37/03* (2006.01)
*H05B 37/02* (2006.01)

(52) U.S. Cl.
CPC ..... *H05B 37/0272* (2013.01); *H05B 37/0227* (2013.01)
USPC ..... 315/129; 315/149; 315/152

(58) Field of Classification Search
CPC ..... H05B 37/0272; H05B 37/0245; H05B 37/02; H05B 37/00; G08C 19/00
See application file for complete search history.

(56) References Cited

U.S. PATENT DOCUMENTS

| | | | | |
|---|---|---|---|---|
| 6,169,377 | B1 * | 1/2001 | Bryde et al. | 315/294 |
| 6,630,800 | B2 * | 10/2003 | Weng | 315/291 |
| 6,633,472 | B2 * | 10/2003 | Lai | 361/93.1 |
| 6,828,733 | B1 * | 12/2004 | Crenshaw | 315/150 |
| 7,142,932 | B2 * | 11/2006 | Spira et al. | 700/83 |
| 7,609,328 | B2 * | 10/2009 | Iwahashi | 348/734 |
| 7,683,755 | B2 * | 3/2010 | Ostrovsky et al. | 340/3.9 |
| 8,049,427 | B2 * | 11/2011 | Altonen et al. | 315/129 |
| 8,063,568 | B2 * | 11/2011 | Bergman et al. | 315/149 |
| 8,350,744 | B2 * | 1/2013 | Belz et al. | 341/176 |
| 8,405,783 | B2 * | 3/2013 | Taya | 348/734 |

FOREIGN PATENT DOCUMENTS

JP 2009-238530 10/2009

* cited by examiner

*Primary Examiner* — Alexander H Taningco
*Assistant Examiner* — Nelson Correa
(74) *Attorney, Agent, or Firm* — Patterson & Sheridan LLP

(57) ABSTRACT

According to one embodiment, a lighting system includes a luminaire and a lighting control device. The lighting control device includes an operation section, a target-value managing section, a transmitting section, and a display section and controls the luminaire. The target-value managing section stores an operation state of the luminaire and, when the operation section is operated, calculates an operation target value on the basis of the stored operation state of the luminaire and updates the operation state to the operation target value serving as an operation state of the luminaire after the operation. The transmitting section transmits the operation target value as a radio signal. The display section performs display based on the operation target value.

5 Claims, 7 Drawing Sheets

LIGHTING SYSTEM, CONTROL METHOD THEREFOR AND LIGHTING CONTROL DEVICE

CROSS-REFERENCE TO RELATED APPLICATIONS

This application is based upon and claims the benefit of priority from Japanese Patent Application No. 2012-134754, filed on Jun. 14, 2012; the entire contents of which are incorporated herein by reference.

FIELD

Embodiments described herein relate generally to a lighting system, a control method for the lighting system, and a lighting control device.

BACKGROUND

For example, there is a radio control system that controls the brightness of a luminaire using a remote operation device. In such a radio control system, a one-way system for transmission from the remote operation device to the luminaire is used as a simple configuration. Therefore, the remote operation device needs to store an operation state of the system in order to display the operation state of the system. In general, since the remote operation device operates with battery power, power consumption is limited. Therefore, it is likely that an operation state stored in the remote operation device and an actual operation state of the luminaire are different because of a communication error or the like.

SUMMARY OF THE INVENTION

Figure 1:
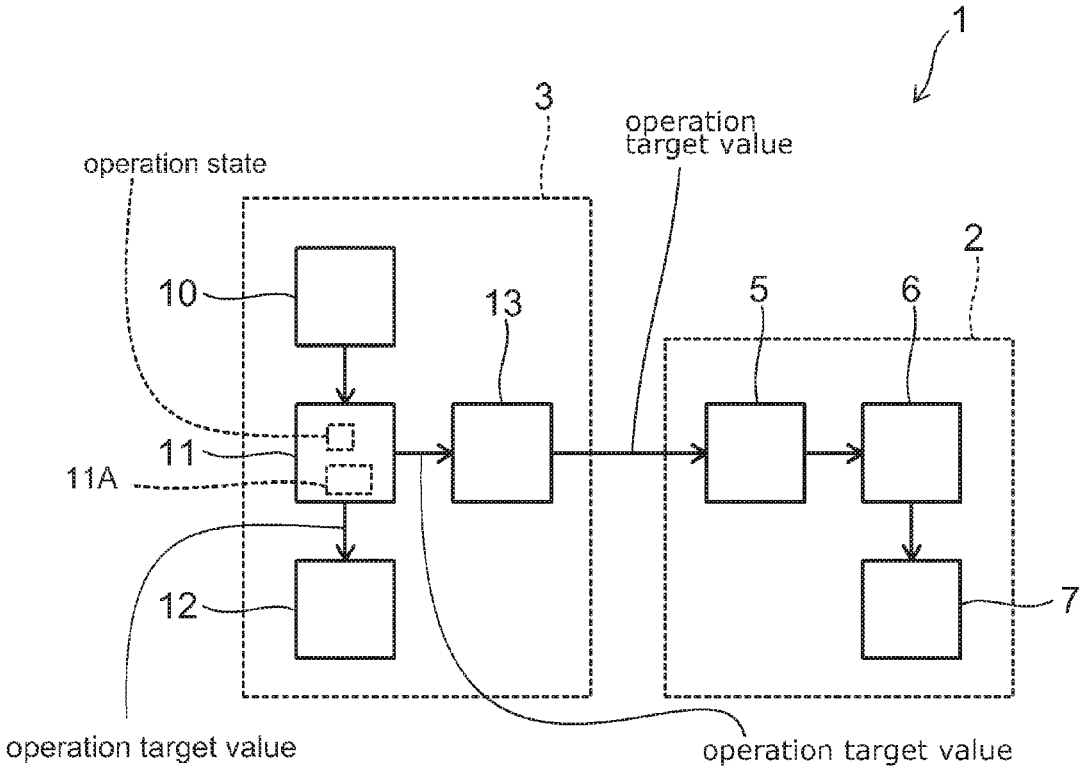
FIG. 1 is a block diagram illustrating a lighting system according to a first embodiment.

In general, according to one embodiment, a lighting system includes a luminaire and a lighting control device. The lighting control device includes an operation section, a target value managing section, a transmitting section, and a display section and controls the luminaire. The target-value managing section stores an operation state of the luminaire and, when the operation section is operated, calculates an operation target value on the basis of the stored operation state of the luminaire and updates the operation state to the operation target value serving as an operation state of the luminaire after the operation. The transmitting section transmits the operation target value as a radio signal. The display section performs display based on the operation target value.

Embodiments are explained in detail below with reference to the accompanying drawings. The drawings are schematic or conceptual. Relations between shapes and longitudinal and lateral dimensions of sections, ratios of the sizes of the sections, and the like are not always the same as real ones. The same sections are sometimes shown at different dimensions and ratios depending on the drawings. Further, in the specification and the drawings, components same as those already explained with reference to the drawings are denoted by the same reference numerals and signs and detailed explanation of the components is omitted.

DETAILED DESCRIPTION

First Embodiment

FIG. 1 is a block diagram illustrating a lighting system according to a first embodiment.

Figure 2:
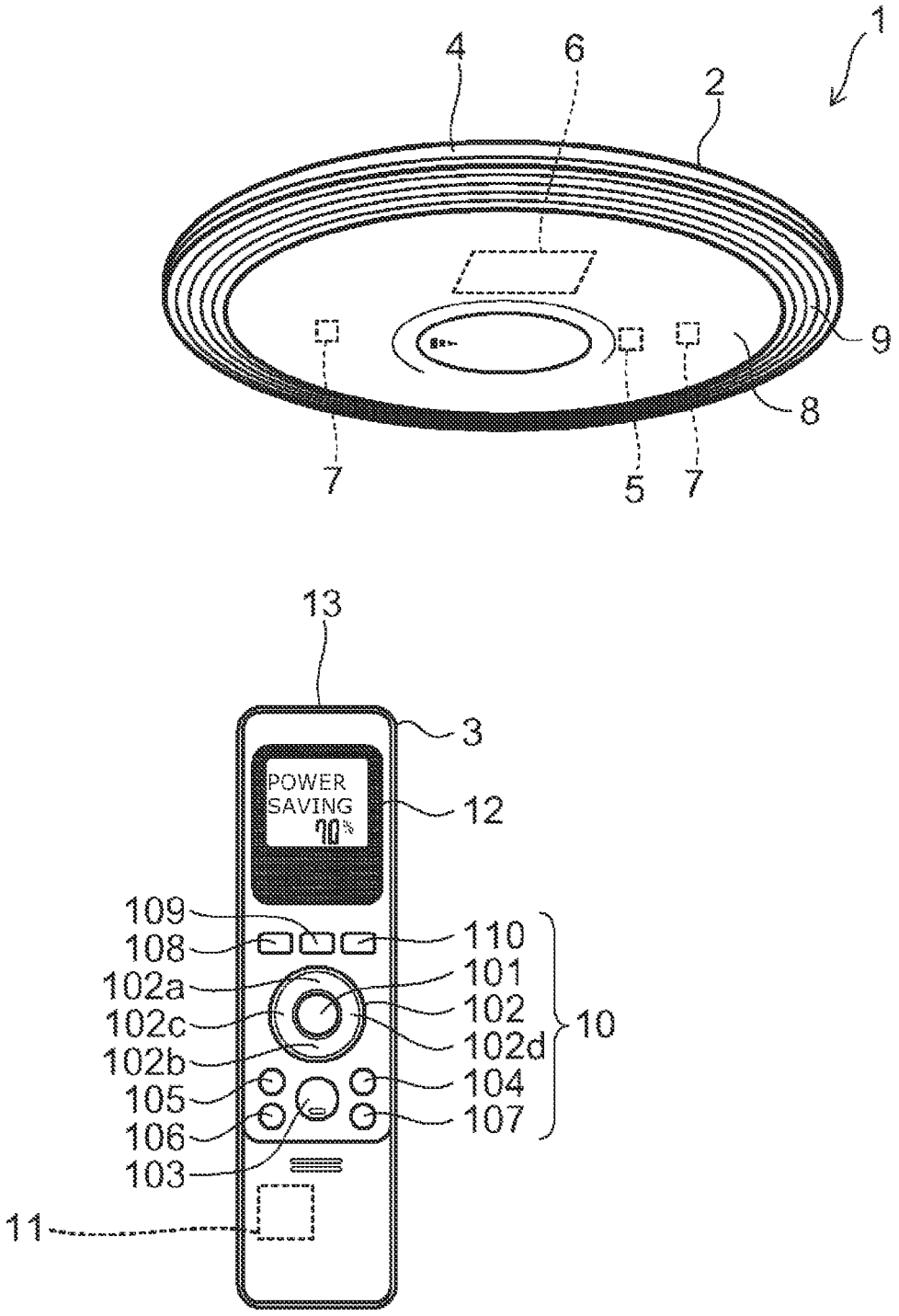
FIG. 2 is a perspective view illustrating the lighting system.

FIG. 2 is a perspective view illustrating the lighting system.

A lighting system 1 according to the embodiment includes a luminaire 2 and a lighting control device 3 that controls the luminaire 2 using a radio signal.

The luminaire 2 is a so-called ceiling light used while being mounted on the ceiling. The luminaire 2 includes a housing 4, a receiving section 5, a control section 6, a light source section 7, a translucent cover 8, and a decoration frame 9.

The housing 4 forms an external appearance on an attachment surface side in the luminaire 2. The housing 4 is mounted with the receiving section 5, the control section 6, and the light source section 7. The housing 4 functions as a supporting body that supports the translucent cover 8 and the decoration frame 9.

The receiving section 5 is provided on the housing 4. The receiving section 5 receives a radio signal, for example, an infrared signal transmitted from the lighting control device 3.

The control section 6 demodulates the radio signal received by the receiving section 5 to generate an operation target value and controls an operation state of the luminaire 2 including the light source section 7.

The light source section 7 includes an illumination light source. A lighting state such as a light output and a light color of the light source section 7 is controlled by the control section 6. The illumination light source is, for example, a light emitting diode (LED). The illumination light source is provided with a light emitting surface faced to the opposite side of an attachment surface of the housing 4. In the specific example, a configuration in which the light source section 7 includes two illumination light sources is illustrated. However, the number of illumination light sources can be set to an arbitrary number according to a power supply voltage, a light output, a light color, and the like. As the illumination light source, besides the LED, for example, an organic light emitting diode (OLED), an inorganic electroluminescence illumination light source, or a fluorescent lamp can be used.

The translucent cover 8 forms an external appearance on a light extraction surface side in the luminaire 2. The translucent cover 8 functions as a frame that protects the receiving section 5, the control section 6, and the light source section 7. The translucent cover 8 is formed of, for example, resin having optical transparency. The translucent cover 8 is colored in, for example, a milky-white color and is formed translucent enough for making the light source section 7 and the like invisible from the outside.

The decoration frame 9 is provided from a viewpoint of design properties in the luminaire 2. The decoration frame 9 is formed of, for example, resin and is colored in a color different from the color of the translucent cover 8. In the specific example, a configuration in which the decoration frame 9 surrounds the translucent cover 8 is illustrated. However, a configuration not including the decoration frame 9 is also possible.

The lighting control device 3 includes an operation section 10, a target managing section 11 that calculates an operation target value when the operation section 10 is operated, a display section 12 that performs display based on the operation target value, and a transmitting section 13 that transmits the operation target value. When the operation section 10 is operated, the lighting control device 3 transmits the operation target value and controls a light output and a light color of the light source section 7 via the control section 6 in the luminaire 2. In the specific example, a configuration in which the lighting control device 3 is formed in a substantially rectangular parallelepiped is illustrated. However, the external shape of the lighting control device 3 may be other shapes and is arbitrary.

The operation section 10 is provided on the surface of the lighting control device 3. The operation section 10 includes plural operation input sections 101 to 110 that can be operated by a user. Functions of the operation input sections 101 to 110 are briefly explained. A full-light-operation input section (hereinafter, full-light button) 101 instructs the luminaire 2 to maximize the light output of the light source section 7 in the luminaire 2. In a circle-like operation input section 102, upper, lower, left, and right source places can be depressed. An upper side (hereinafter, "bright" button) 102*a* of the operation input section 102 instructs the luminaire 2 to increase the light output and light up. A lower side (hereinafter, "dark" button) 102*b* of the operation input section 102 instructs the luminaire to reduce the light output and darken. A left side (hereinafter, bulb color button) 102*c* of the operation input section 102 instructs the luminaire 2 to set the light color closer to a bulb color. A right side (hereinafter, white color button) 102*d* of the operation input section 102 instructs the luminaire 2 to set the light color closer to a white color. A turn-off-operation input section (hereinafter, turn-off button) 103 instructs the luminaire 2 to reduce the light output to zero and turn off light. Although not explained in detail herein, plural operation input sections 104 to 110 are further provided. In the specific example, the plural operation input sections 101 to 110 project outward from the surface of the lighting control device 3. The plural operation input sections 101 to 110 are formed in a button shape that can be depressed by the user. However, the operation input sections may have other forms as long as input operation by the user is possible. The operation input sections may be, for example, a touch panel. In the following explanation, operating the operation input sections is referred to as "depress a button" and completing the operation of the operation input sections is referred to as "release a button".

The target managing section 11 is provided on the inside of the lighting control device 3. The target managing section 11 detects presence or absence of operation of the operation input sections 101 to 110 in the operation section 10 and generates a control signal corresponding to an operation input section operated in the operation section 10. The target managing section 11 stores an operation state of the luminaire 2 and calculates an operation target value corresponding to the operated operation input section. For example, if the full-light button 101 is operated in a turned-off state, the target managing section 11 detects the depression of the full-light button 101 and sets a maximum light output as the operation target value. For example, if the "bright" button 102*a* is operated in the turned-off state, the target managing section 11 detects the depression of the "bright" button 102*a* and sets, as the operation target value, a light output and a light color in the stored operation state of the luminaire 2. If the bulb color button 102*c* is operated in a state in which the luminaire 2 is on at a predetermined light output and a predetermined light color, the target managing section 11 detects the depression of the bulb color button 102*c* and calculates, as the operation target value, a light color closer to the bulb color side on the basis of the light color in stored operation state of the luminaire 2. The target managing section 11 generates, on the basis of the operation target value, a control signal for controlling the luminaire 2. The target managing section 11 can include, for example, a microcomputer 11A.

The display section 12 is provided on the surface of the lighting control device 3 and performs display based on the operation target value when the operation section 10 is operated. The display section 12 can display, for example, with full light set as 100%, a light output in an operation state of the luminaire 2 as a ratio to the full light. The display section 12 can display, with power consumption at the full-light time set as 100%, power consumption in the operation state of the luminaire 2 as a numerical value for power saving. Besides displaying the power consumption as a numerical value, the display section 12 may display a light output and a light color stepwise as a bar graph or the like. The display section 12 can include, for example, a liquid crystal panel. Display data displayed by the display section 12 can be generated by the target managing section 11.

The transmitting section 13 is provided on a side of the lighting control device 3. The transmitting section 13 modulates the control signal generated by the target managing section 11 into a radio signal and transmits the radio signal. The transmitting section 13 includes, for example, infrared light emitting element exposed on the side of the lighting control device 3 and transmits a radio signal of an infrared ray. The transmitting section 13 only has to be capable of transmitting the control signal as a radio signal and may transmit the control signal as a radio wave in a specific band besides the infrared ray.

The operation of the lighting system 1 according to the embodiment is explained.

Figure 3A:
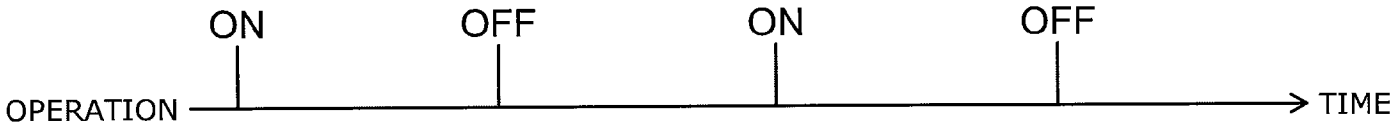
FIGS. 3A and 3B are timing charts illustrating the structure of a main signal in the first embodiment.
Figure 3B:
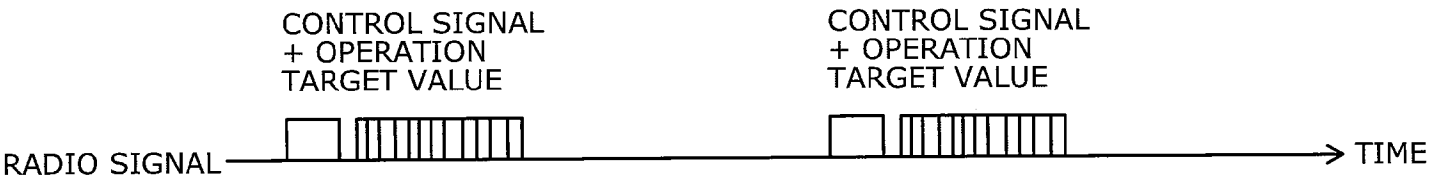

FIGS. 3A and 3B are timing charts illustrating the structure of a main signal in the first embodiment. ON and OFF operation of the operation section is shown in FIG. 3A. A radio signal is shown in FIG. 3B.

In FIGS. 3A and 3B, a signal in the case of so-called "single press" is shown. In the "single press", after a button functioning as an operation input section of the operation section 10 is depressed and the operation input section is turned on, the button is released and the operation input section is turned off within a predetermined time and operation is completed within the predetermined time.

If the operation input section of the operation section 10 is depressed and turned on (FIG. 3A), the lighting control device 3 transmits a control signal including an operation target value as a radio signal corresponding to the operated operation input section (FIG. 3B). At this point, the lighting control device 3 calculates an operation target value on the basis of the stored operation state of the luminaire 2 and updates the operation state to the operation target value serving as an operation state of the luminaire 2 after the operation. The luminaire 2 demodulates the received radio signal to generate the control signal and controls the light output and the light color of the light source section 7 to be the operation target value included in the control signal.

Figure 4:
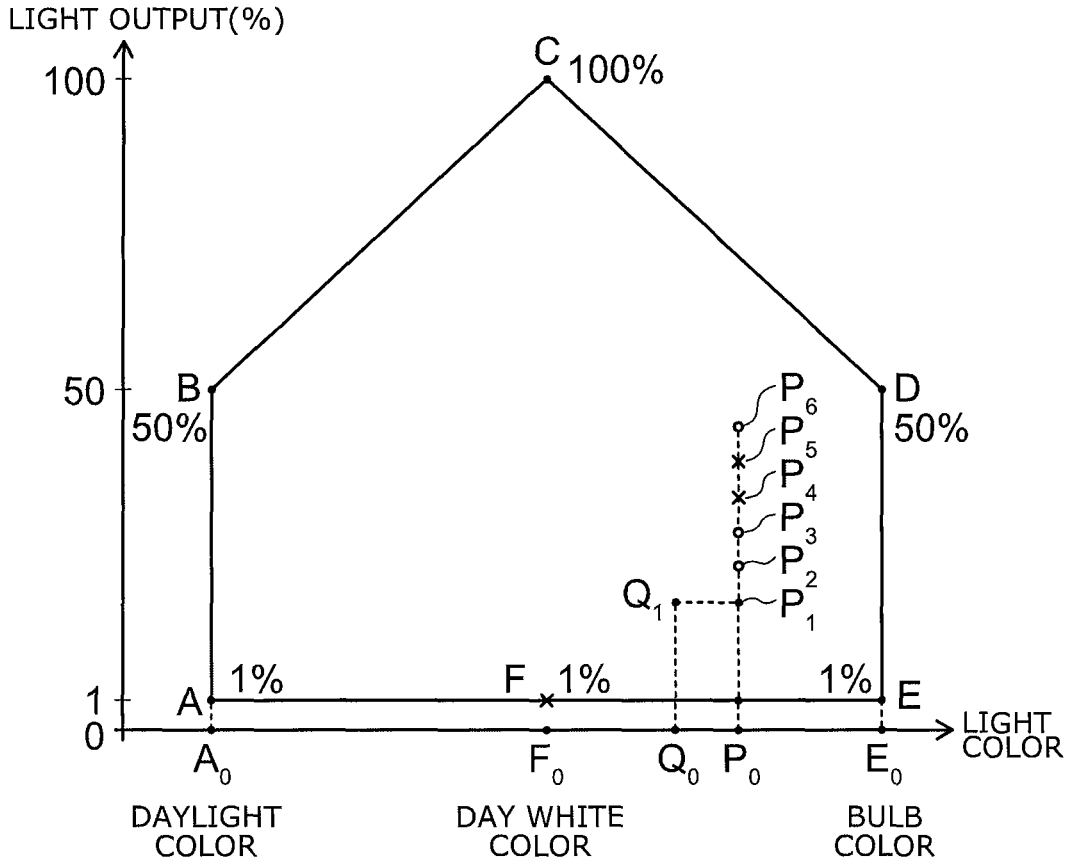
FIG. 4 is a schematic diagram illustrating operation target values.

FIG. 4 is a schematic diagram illustrating operation target values.

In FIG. 4, a light color is plotted on the abscissa and a light output is plotted on the ordinate. As the operation target values, a range in which the light output and the light color of the light source section 7 in the luminaire 2 can be controlled is represented by a polygon formed by connecting an A point, a B point, a C point, a D point, an E point, an F point, and the A point and a straight line formed by connecting an $A_0$ point, an $F_0$ point, and an E point. The A point indicates an operation target value at which the light color of the light source section 7 is a daylight color and the light output of the light source section 7 is the minimum. The B point indicates an operation target value at which the light color of the light source section 7 is the daylight color and the light output of the light source section 7 is 50%. The C point indicates an operation target value at which the light color of the light source section 7 is a day white color and the light output of the light source section 7 is the maximum 100%. The D point indicates an operation target value at which the light color of the light source section 7 is a bulb color and the light output of the light source section 7 is 50%. The E point indicates an operation target value at which the light color of the light source section 7 is the bulb color and the light output of the light source section 7 is the minimum. The F point indicates an operation target value at which the light color of the light source section 7 is the day white color and the light output of the light source section 7 is the minimum. The $A_0$ point, the $F_0$ point, and the $E_0$ point respectively indicate operation target values at which the light source section 7 is turned off to reduce the light output of the light source section 7 to 0% from the A point, the F point, and the E point while the light color of the light source section 7 is maintained.

If the lighting control device 3 calculates an operation target value on the basis of the stored operation state of the luminaire 2, the lighting control device 3 limits the operation target value to a value within the range of the polygon ABCDEF and the straight line $A_0F_0E_0$, which is the range in which the light output and the light color can be controlled. Like the operation target values, operation states of the luminaire 2 are represented by the polygon ABCDEF and the straight line $A_0F_0E_0$.

For example, it is assumed that the light source section 7 is turned off and an actual operation state of the luminaire 2 and the operation state stored in the lighting control device 3 are the $F_0$, point. When the full-light button 101 is depressed in this state, the lighting control device 3 transmits a control signal for setting the C point as an operation target value as a radio signal.

The luminaire 2 demodulates the received radio signal to generate the control signal and controls the light output and the light color of the light source section 7 to control the light source second 7 to operate at the C point, which is the operation target value.

When the light source section 7 is off, if the operation state stored in the lighting control device 3 is, for example, the $A_0$ point or the $E_0$ point other than the $F_0$ point, as in the case explained above, the lighting control device 3 transmits the control signal for setting the C point as an operation target value as a radio signal. Therefore, the luminaire 2 that receives the radio signal controls the light source section 7 to operate at the C point, which is the operation target value, irrespective of an operation state of the luminaire 2.

In the above explanation, the full-light button 101 is operated. However, the same applies when the other buttons are operated. For example, when the light source section 7 is off, the operation state stored in the lighting control device 3 is a $P_0$ point and the operation state stored in the luminaire 2 is a $Q_0$ point and, therefore, the operation states are different. When the "bright" button 102*a* is depressed in this state, for example, the lighting control device 3 transmits a radio signal as a control signal for setting a $P_1$ point as an operation target value. The luminaire 2 that receives the radio signal controls the light source section 7 to operate at the $Q_0$ point, which is the stored operation state, to the $P_1$ point, which is the operation target value. Therefore, even if the luminaire 2 may not be able to receive the operation target value because of, for example, a communication error, the operation state of the luminaire 2 is controlled according to an operation target value, which can be normally received next, such that the light source section 7 operates at the operation target value.

Further, when an operation state is the $P_1$ point, for example, if the "bright" button 102*a* is depressed, the lighting control device 3 transmits a radio signal as a control signal for setting a $P_2$ point as an operation target value. The luminaire 2 that receives the ratio signal controls the light source section 7 to operate at the $P_1$ point, which is the stored operation state, to the $P_2$ point, which is the operation target value. Similarly, if the "bright" button 102*a* is repeatedly operated and the luminaire 2 can normally receive operation target values, the luminaire 2 controls the light source section 7 to operate at operation target values of a $P_3$ point, a $P_4$ point, a $P_5$ point, and a $P_6$ point, respectively. If the luminaire 2 may not be able to normally receive the operation target values halfway, for example, the luminaire 2 controls the light source section 7 to operate at the $P_3$ point to the $P_6$ point, which are the operation target values.

Effects of the first embodiment are explained.

In the embodiment, the lighting control device 3 calculates an operation target value on the basis of the stored operation state of the luminaire 2 and controls the luminaire 2. Therefore, the display section 12 of the lighting control device 3 can perform display on the basis of the operation state of the luminaire 2. For example, the display section 12 can display, with the full light set as 100%, a light output in the operation state of the luminaire 2 as a ratio to the full light. The display section 12 can display power saving as a value (a subtracted value) obtained by subtracting power consumption in the operation state of the luminaire 2 from power consumption during the full light.

For example, if an operation target value is not included in a control signal, the light output of the luminaire 2 is controlled to be brighter stage by stage according to the operation of the "bright" button 102*a*. However, a state in which an actual operation state caused when the luminaire 2 may not be able to receive the control signal because of a communication error or the like and the operation state stored in the lighting control device 3 are different is not eliminated, for example, until the light source section 7 changes to a full-light state.

On the other hand, in the embodiment, when the operation section 10 is operated, the lighting control device 3 transmits an operation target value corresponding to the operation. Therefore, even if the luminaire 2 may not be able to receive an operation target value because of a communication error, the luminaire 2 can control, according to an operation target value that can be received next, the light source section 7 to the operation target value. As a result, if display concerning the operation state of the luminaire 2 is performed in the lighting control device 3, the state in which the operation state is different from the actual operation state due a communication error or the like is eliminated.

Second Embodiment

A lighting system according to a second embodiment is different from the first embodiment in the structure of a radio signal transmitted from the lighting control device 3 as a control signal when the operation section 10 is operated.

If an operation input section of the operation section 10 is continuously pressed, the lighting control device 3 according to the embodiment transmits a repeat signal shorter than the control signal. At this point, the lighting control device 3 calculates an operation target value on the basis of the stored operation state of the luminaire 2 and updates the operation state to the operation target value serving as an operation state of the luminaire 2 after the repeat operation. When the operation input section of the operation section 10 is released and the operation of the operation section 10 is completed, the lighting control device 3 transmits a control signal including the operation target value.

Figure 5A:
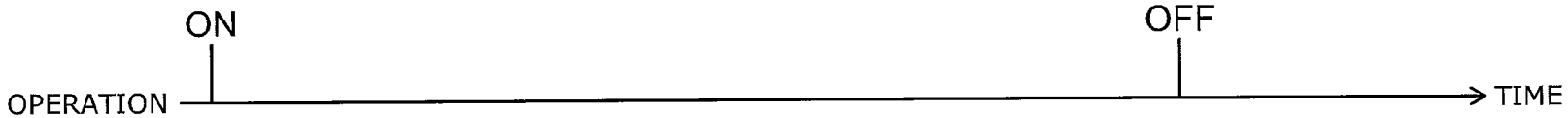
FIGS. 5A and 5B are timing charts illustrating the structure of a main signal in a second embodiment.
Figure 5B:
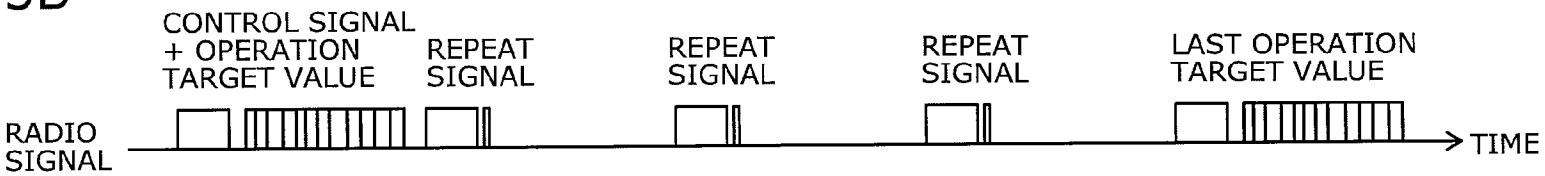

FIGS. 5A and 5B are timing charts illustrating the structure of a main signal in the second embodiment. ON and OFF operation of the operation section is shown in FIG. 5A. A radio signal is shown in FIG. 5B.

In FIGS. 5A and 5B, a signal in the case of so-called "continuous press" is shown. In the "continuous press", after a button functioning as an operation input section of the operation section 10 is depressed and the operation input section is turned on, the button is kept depressed and the operation input section is kept on for a predetermined time or more and operation is not completed within the predetermined time.

The operation of the lighting system according to the embodiment is explained with reference to FIG. 4 and FIGS. 5A and 5B.

For example, it is assumed that, when the light source section 7 is off, the operation state stored in the lighting control device 3 is a $P_0$ point and the operation state stored in the luminaire 2 is a $Q_0$ point and, therefore, the operation states are different. When the "bright" button 102*a* is depressed in this state (FIG. 5A), for example, the lighting control device 3 transmits a radio signal as a control signal for setting a $P_1$ point as an operation target value (FIG. 5B). The luminaire 2 that receives the radio signal controls the light source section 7 to operate at the $Q_0$ point, which is the stored operation state, to the $P_1$ point, which is the operation target value. Therefore, even if the luminaire 2 may not be able to receive the operation target value because of, for example, a communication error, the operation state of the luminaire 2 is controlled to an operation target value that can be normally received next. The operation explained above is the same as the operation in the first embodiment.

It is assumed that the "bright" button 102*a* is not released within a predetermined time. When an operation state is the $P_1$ point, if the "bright" button 102*a* is kept depressed and the lighting system 1 is kept on (FIG. 5A), the lighting control device 3 transmits a repeat signal shorter than the control signal including the operation target value (FIG. 5B). The lighting control device 3 calculates an operation target value on the basis of the stored operation state of the luminaire 2 and updates the operation state to the operation target value serving as an operation state of the luminaire 2 after the operation. The luminaire 2 that receives the repeat signal controls the light source section 7 to operate at the $P_1$ point, which is the stored operation state, to the $P_2$ point brighter by one stage.

Similarly, if the "bright" button 102*a* is not released within a predetermined time after the repeat signal is transmitted (FIG. 5A), the lighting control device 3 repeatedly transmits the repeat signal (FIG. 5B). The lighting control device 3 repeatedly calculates an operation target value on the basis of the stored operation state of the luminaire 2 and updates the operation state to the operation target value serving as an operation state of the luminaire 2 after the operation. If the luminaire 2 can normally receive the repeat signal, the luminaire 2 controls the light source section 7 to operate at the $P_3$ point brighter by one stage.

If the "bright" button 102*a* is released and the operation input section is turned off in this state (FIG. 5A), the lighting control device 3 transmits a control signal including the $P_3$ point, which corresponds to the operation state stored last, as an operation target value. The luminaire 2 that receives the control signal controls the light source section 7 to the received operation target value irrespective of an actual operation state. For example, if the luminaire 2 is operating at the $P_3$ point, the luminaire 2 continues the operation at the $P_3$ point. If the luminaire 2 is not operating at the $P_3$ point, the luminaire 2 controls the light source section 7 to operate at the $P_3$ point, which is the operation target value.

In the above explanation, the operation performed when the "bright" button 102*a* is operated is illustrated. However, operations performed when the other buttons such as the "dark" button 102*b*, the bulb color button 102*c*, and the white color button 102*d* are operated are the same. The "one stage" in the operation performed by the luminaire 2 when the repeat signal is received can be set in advance in the luminaire 2. The "one stage" can be set in the luminaire 2 by transmitting a value of the "one stage" from the lighting control device 3 to the luminaire 2 as a control signal.

In the embodiment, besides the effects in the first embodiment, since the lighting control device 3 transmits the repeat signal shorter than the control signal including the operation target value when the operation section 10 is continuously pressed, it is possible to reduce the power consumption of the lighting control device 3. As a result, if a battery is used as a power supply for the lighting control device 3, it is possible to extend a usable time of the battery.

For example, when the repeat signal is transmitted and the operation of the operation section 10 is completed, if the control signal including the operation target value is not transmitted, a light output of the luminaire 2 is controlled to be brighter stage by stage according to the repeat signal. However, in some case, the luminaire 2 may not be able to receive the control signal because of a communication error or the like. Therefore, it is likely that an actual operation state and the operation state stored in the lighting control device 3 are different. This state may not be able to be eliminated unless the "bright" button 102*a* is repeatedly operated until the light output reaches the maximum.

On the other hand, in the embodiment, when the operation of the operation section 10 is completed, the lighting control device 3 transmits the control signal including the updated operation target value. Therefore, even if the luminaire 2 may not be able to receive the repeat signal because of a communication error or the like, the luminaire 2 can control the light source section 7 to the operation target value according to the control signal including the operation target value. As a result, if the lighting control device 3 performs display concerning an operation state of the luminaire 2, it is possible to eliminate, while reducing power consumption, a state in which the operation state is different from an actual operation state due to a communication error or the like.

Third Embodiment

A lighting system according to a third embodiment is different from the first embodiment in the structure of a radio signal transmitted from the lighting control device 3 when the operation section 10 is operated.

Figure 6A:
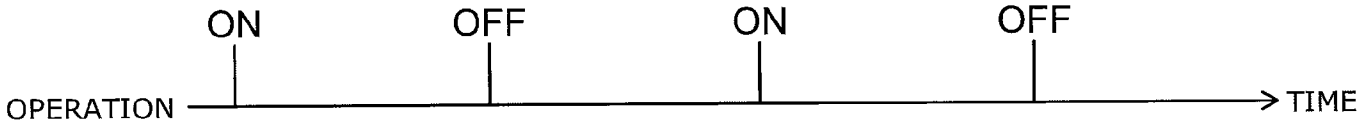
FIGS. 6A and 6B are timing charts illustrating the structure of a main signal in a third embodiment.
Figure 6B:
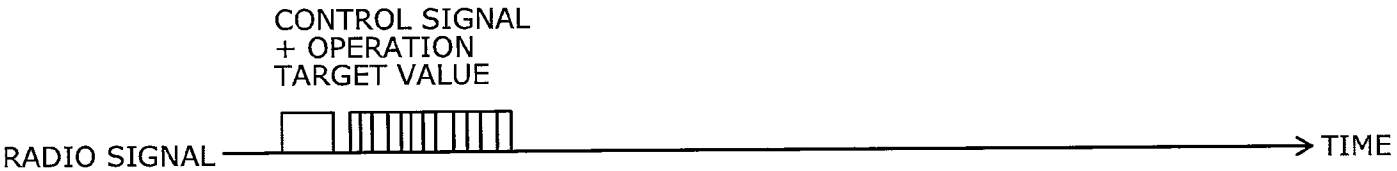

FIGS. 6A and 6B are timing charts illustrating the structure of a main signal in the third embodiment. ON and OFF operation of the operation section is shown in FIG. 6A. A radio signal is shown in FIG. 6B.

In FIGS. 6A and 6B, a signal in the case of so-called "single press" is shown. In the "single press", after a button functioning as an operation input section of the operation section 10 is depressed and the operation input section is turned on, the button is released and the operation input section is turned off within a predetermined time and operation is completed within the predetermined time.

If the operation input section of the operation section 10 is depressed and turned on (FIG. 6A), the lighting control device 3 according to the embodiment calculates an operation target value on the basis of the stored operation state of the luminaire 2. If the operation target value is different from the stored operation state of the luminaire 2, the lighting control device 3 updates the operation state to the operation target value serving as an operation state of the luminaire 2 after the operation. The lighting control device 3 transmits a radio signal as a control signal including the operation target value (FIG. 6B). The luminaire 2 demodulates the received radio signal to generate the control signal and controls a light output or a light color of the light source section 7 to be the operation target value included in the control signal. If the operation target value is the same as the stored operation state of the luminaire 2 and the operation state of the luminaire 2 is not changed, the lighting control device 3 does not transmit the radio signal (FIG. 6B).

In the embodiment, besides the effects in the first embodiment, since the lighting control device 3 does not transmit the radio signal if the operation target value corresponding to the operation of the operation section 10 is the same as the operation state of the luminaire 2, it is possible to further reduce the power consumption of the lighting control device 3. As a result, if a battery is used as a power supply for the lighting control device, it is possible to further extend a usable time of the battery.

In the above explanation, the configuration in which the lighting control device 3 does not transmit the radio signal if the operation target value is the same as the stored operation state of the luminaire 2 is illustrated. However, it is also possible to adopt a configuration in which the lighting control device 3 does not transmit the radio signal if the operation target value is continuously the same as the stored operation state of the luminaire 2 a predetermined number of times or more.

Fourth Embodiment

A lighting system according to a fourth embodiment is different from the second embodiment in the structure of a radio signal transmitted from the lighting control device 3 as a control signal when the operation section 10 is operated.

Figure 7A:
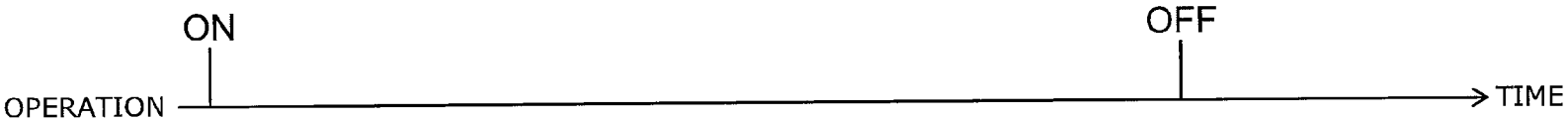
FIGS. 7A and 7B are timing charts illustrating the structure of a main signal in a fourth embodiment.
Figure 7B:
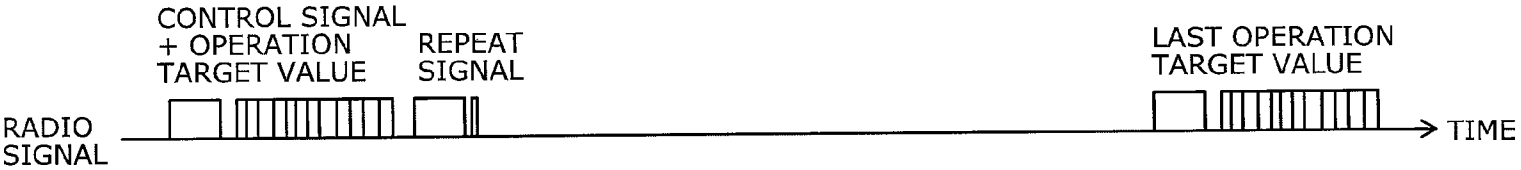

FIGS. 7A and 7B are timing charts illustrating the structure of a main signal in the fourth embodiment. ON and OFF operation of the operation section is shown in FIG. 7A. A radio signal is shown in FIG. 7B.

In FIGS. 7A and 7B, a signal in the case of so-called "continuous press" is shown. In the "continuous press", after a button functioning as an operation input section of the operation section 10 is depressed and the operation input section is turned on, the button is kept depressed and kept on for a predetermined time or more and operation is not completed within the predetermined time.

If an operation input section of the operation section 10 is continuously pressed (FIG. 7A), the lighting control device 3 according to the embodiment calculates an operation target value on the basis of the stored operation state of the luminaire 2. If the operation target value is different from the stored operation state of the luminaire 2, the lighting control device 3 updates the operation state to the operation target value serving as an operation state of the luminaire 2 after the operation. The lighting control device 3 transmits a repeat signal shorter than a control signal (FIG. 7B). If the operation target value is the same as the stored operation state of the luminaire 2 and the operation state of the luminaire 2 is not changed, the lighting control device 3 does not transmit the repeat signal (FIG. 7B). When the operation input section of the operation section 10 is released and the operation of the operation section 10 is completed, the lighting control device 3 transmits a control signal including the operation target value.

In the specific example, a configuration in which, even if the repeat signal is not transmitted, when the operation input section of the operation section 10 is released and the operation of the operation section 10 is completed, the lighting control device 3 transmits the control signal including the operation target value is illustrated (FIG. 7B). However, the lighting control device 3 can also be configured to, if the lighting control device 3 does not transmit the repeat signal, transmit the control signal including the operation target value and ends the transmission before the operation of the operation section 10 is completed.

In the embodiment, besides the effects in the second embodiment, since the lighting control device 3 does not transmit the repeat signal if the operation section 10 is continuously operated for the predetermined time or more and the calculated target value is the same as the stored operation state of the luminaire 2, it is possible to further reduce the power consumption of the lighting control device 3. As a result, if a battery is used as a power supply for the lighting control device 3, it is possible to further extend a usable time of the battery.

The embodiments are explained above with reference to the specific examples. However, the present invention is not limited to the embodiments and various modifications are possible.

For example, the luminaire may be a chandelier, a pendant, a downlight, a spotlight, and the like besides the ceiling light. In the luminaire, any one of a bulb, a fluorescent lamp, various discharge tubes, an light emitting diode (LED), a laser element, an electroluminescent (EL) element, and other various light-emitting elements may be used as the light source. The luminaire may be an outdoor luminaire besides an indoor luminaire. The planar shape of the luminaire is not limited to a circular shape and may be a polygonal shape such as a rectangle shape besides an elliptical shape.

While certain embodiments have been described, these embodiments have been presented by way of example only, and are not intended to limit the scope of the inventions. Indeed, the novel embodiments described herein may be embodied in a variety of other forms; furthermore, various omissions, substitutions, and changes in the form of the embodiments described herein may be made without departing from the spirit of the inventions. The accompanying claims and their equivalents are intended to cover such forms or modifications as would fall within the scope and spirit of the inventions.

What is claimed is:

1. A lighting system comprising:

a luminaire; and a lighting control device configured to control the luminaire and including:

an operation section;

a target value managing section configured to store an operation state of the luminaire and, when the operation section is operated, set as an operation target value a light output of the luminaire when a first operation input section is pressed and a light color of the luminaire when a second operation input section is pressed and update the operation state to the operation target value serving as an operation state of the luminaire after the operation;

a transmitting section configured to transmit a control signal including the the operation target value as a radio signal; and a display section configured to perform display based on the operation target value, wherein the display section is configured to display power consumption of the luminaire during operation as a percentage of power consumption of the luminaire during maximum output or display power savings as a value obtained by subtracting the power consumption of the luminaire during operation from the power consumption of the luminaire during maximum output, and wherein the lighting control device is configured to transmit a signal shorter than the control signal as the radio signal when the pressing operation of the first or second operation input section is continued and to transmit the control signal as the radio signal when the pressing operation of the first or second operation input section is completed.

2. A lighting system comprising:

a luminaire; and a lighting control device configured to control the luminaire and including:

an operation section;

a target value managing section configured to store an operation state of the luminaire and, when the operation section is operated, set as an operation target value a light output of the luminaire when a first operation input section is pressed and a light color of the luminaire when a second operation input section is pressed and update the operation state to the operation target value serving as an operation state of the luminaire after the operation;

a transmitting section configured to transmit a control signal including the the operation target value as a radio signal; and a display section configured to perform display based on the operation target value, wherein the display section is configured to display power consumption of the luminaire during operation as a percentage of power consumption of the luminaire during maximum output or display power savings as a value obtained by subtracting the power consumption of the luminaire during operation from the power consumption of the luminaire during maximum output, and wherein, if the set operation target value is different from the stored operation state of the luminaire, the lighting control device transmits the control signal as the radio signal.

3. The system according to claim 1, wherein, when the pressing operation of the first or second operation input section is continued, if the operation target value is the same as the operation state of the luminaire, the lighting control device transmits the control signal as a radio signal and ends the transmission before the pressing operation of the first or second operation input section is completed.

4. A control method for a lighting system including a luminaire and a lighting control device including an operation section and configured to control the luminaire, the method comprising:

storing an operation state of the luminaire;

setting, when the operation section is operated, as an operation target value a light output of the luminaire when a first operation input section is pressed and a light color of the luminaire when a second operation input section is pressed and updating the operation state to the operation target value as an operation state of the luminaire after the operation;

transmitting a control signal including the operation target value as a radio signal;

performing display based on the operation target value;

displaying power consumption of the luminaire during operation as a percentage of power consumption of the luminaire during maximum output or displaying power savings as a value obtained by subtracting the power consumption of the luminaire during operation from the power consumption of the luminaire during maximum output;

transmitting a signal shorter than the control signal as the radio signal when the pressing operation of the first or second operation input section is continued; and transmitting the control signal as the radio signal when the pressing operation of the first or second operation input section is completed.

5. The method according to claim 4, further comprising transmitting, if the operation target value is different from the stored operation state of the luminaire, the control signal as the radio signal.

* * * * *